US005244294A

United States Patent [19]

Ewing

[11] Patent Number: 5,244,294

[45] Date of Patent: Sep. 14, 1993

[54] APPARATUS FOR TRANSPORTING WET PRINT MEDIA AND METHOD FOR SAME

[75] Inventor: Kenneth R. Ewing, Fremont, Calif.

[73] Assignee: Apple Computer, Inc., Cupertino, Calif.

[21] Appl. No.: 905,921

[22] Filed: Jun. 29, 1992

[51] Int. Cl.[5] ..... B41J 13/00

[52] U.S. Cl. ..... 400/625; 271/207; 271/900; 400/628

[58] Field of Search ..... 400/625, 628, 641, 642, 400/636, 629; 271/18, 33, 42, 207, 900; 221/59

[56] References Cited

U.S. PATENT DOCUMENTS

| | | | |
|---|---|---|---|
| 2,727,655 | 12/1955 | Pearce | 221/259 |
| 4,071,165 | 1/1978 | Leopoldi | 221/259 |
| 4,439,777 | 3/1984 | Aprato | 400/656 X |

FOREIGN PATENT DOCUMENTS

| | | | |
|---|---|---|---|
| 0347889 | 12/1989 | European Pat. Off. | 271/18 |
| 0057363 | 3/1986 | Japan | 400/625 |
| 0041137 | 2/1987 | Japan | 271/271 |
| 0130159 | 6/1991 | Japan | 400/625 |

OTHER PUBLICATIONS

IBM Technical Disclosure Bulletin, vol. 30, No. 12, May 1988 Bill Stacker For Bill-Handling Machine.

*Primary Examiner*—Edgar S. Burr
*Assistant Examiner*—Christopher A. Bennett
*Attorney, Agent, or Firm*—Blakely, Sokoloff, Taylor & Zafman

[57] ABSTRACT

The present invention comprises an apparatus and method for transporting print media with wet ink out of a printer without smearing the ink or requiring the user to adjust the margins of the document to avoid the smearing of the ink. The apparatus comprises a platen for holding the print media prior to ejection from the printer, an ejection bar having flexible, resilient fingers for catching the bottom of the print media when flexed and then kicking the paper out of the printer. The ejection bar is actuated by an eccentric cam drive to move it away from the print media when the fingers are traveling toward the bottom edge of the print media, then moving it toward the paper bottom edge to flex the fingers and then upward to eject the paper out of the printer. The upward movement also causes the fingers to spring to an unflexed configuration, thereby kicking the paper out of the printer.

6 Claims, 5 Drawing Sheets

APPARATUS FOR TRANSPORTING WET PRINT MEDIA AND METHOD FOR SAME

BACKGROUND OF THE INVENTION

1. Field of the Invention

This invention relates to printers, particularly wet ink printers, and more particularly, to an apparatus for, and method of, transporting wet print media out of a printer.

2. Art Background

A common problem with prior art ink jet printers which sequentially print on paper or other media using wet ink, particularly those which print rather rapidly, is that the wet ink may not have sufficient time to dry as it is being manipulated by the printer or prior to the printing of a subsequent sheet and its placement over the prior sheet. The obvious result of this problem is that the print on the prior sheet smears, smudges or is otherwise distorted, and/or the ink is absorbed by the back of the subsequent sheet. Many prior art printer systems simply let the ink smear, which has its obvious undesirable characteristics. One approach to solving the problem of slow paper drying is the use of specially coated, faster drying paper which is more expensive than standard paper. Another approach is the use of a drying device, such as a lamp or heater to accelerate drying time; however, such apparatus makes the printer heavier and more expensive, and sometimes causes buckling of the paper. Yet another approach is a passive drop system in which the paper drops at a relatively slow rate and air dries before dropping. Another approach is to provide substantial margins which permit the paper to be grabbed and controlled at its margins so that the ink is not touched at least while the paper is being handled.

Hewlett-Packard discloses in its U.S. Pat. No. 4,794,859 an ink jet printer which prints and stacks paper in a horizontal plane, and provides an active paper drop mechanism comprising a pair of movable rail members which actively guide the paper down to a collection stack. The rail members support a sheet of paper for a predetermined period of time in order to provide the paper with sufficient time to dry before the rail member releases the paper allowing it to touch the last previously printed page. The rail permits manipulation of the paper without touching the printed portion thereof.

To eject paper from a printer, most printers utilize small rotating drive wheels (pinch rollers) which drive the paper through the printer. These may leave long tracks from wet print. Some devices utilize star shaped wheels made of plastic or metal wherein the points of the star contact the paper. However, even these star shaped drive wheels cause small dots across the paper from the wet ink. Alternatively, the star wheels can be positioned outside the print area, but this requires that the print area be reduced so that the star wheels contact only the margin. The star wheels also cause indents in the paper across the entire page. They are also relatively costly.

Thus, it is desirable to provide a new system and method for transporting wet print media out of a printer which handles and manipulates wet print media without the drawbacks of the prior art systems and methods.

SUMMARY OF THE INVENTION

The present invention comprises an apparatus and method for transporting print media with wet ink out of a printer without smearing the ink or requiring the user to adjust the margins of the document to avoid the smearing of the ink. The apparatus comprises a print media support means for holding the print media prior to ejection from the printer, an ejection bar having flexible, resilient fingers for catching the bottom of the print media when flexed and then kicking the paper out of the printer. The ejection bar is actuated by an eccentric cam drive means to move it away from the print media when the fingers are traveling toward the bottom edge of the print media, then moving it toward the paper bottom edge to flex the fingers and then upward to eject the paper out of the printer. The upward movement also causes the fingers to spring to an unflexed configuration, thereby kicking the paper into the output tray.

The bottom print media support plate has cutout portions which align with the fingers and which are disposed to permit the fingers to cock and then release to eject the print media.

The printer preferably is angled backward from vertical, preferably at an angle 30° to 75° from vertical, so that the print media may be retained by gravity on the support means until ejected.

Thus, it is an object of the present invention to provide a printer system which handles and ejects paper without smearing the ink on the paper.

It is another object of the present invention to provide a printer system which handles paper without touching the wet ink printed thereon.

It is another object of the present invention to provide a printer system which handles paper without requiring the reduction of paper margins.

It is another object of the present invention to provide a printer system which prints and discharges the print media without requiring a separate drive mechanism and without the need of "handing off" the printed sheets to a separate discharge operation.

It is another object of the present invention to provide a printer system which discharges the print media in a repeatable and reliable fashion.

It is another object of the present invention to provide a printer system which does not have two separate drive systems, thereby obviating the need for matching the drive motors on the separate drive systems.

It is another object of the present invention to provide a printer system which operates to remove paper from the printer and transport it to a paper retaining bin, the drive system for said transport system operating off of the existing drive system of the printer driver.

BRIEF DESCRIPTION OF THE DRAWINGS

FIG. 6A shows the paper transport means disposed above the paper support means and moving towards the bottom of the paper support means.

FIG. 6B shows the paper transport means contacting the bottom of the paper support means to grab the bottom of the paper disposed thereon.

FIG. 6C shows the paper transport means after the paper is kicked off the paper support means.

FIG. 8A shows the finger first contacting the bottom of the paper to be kicked off the paper support means.

FIG. 8B shows two adjacent fingers, one uncocked and one still cocked, not having reached the recess with which it is aligned.

FIG. 8C shows the movement of the remaining finger.

DETAILED DESCRIPTION OF THE INVENTION

The preferred embodiment of the present invention is described in detail below with reference to the drawings. It will be obvious to a person of ordinary skill in the art that many changes and modifications can be made to the following apparatus and method which will fall within the spirit and scope of the invention.

Figure 1:
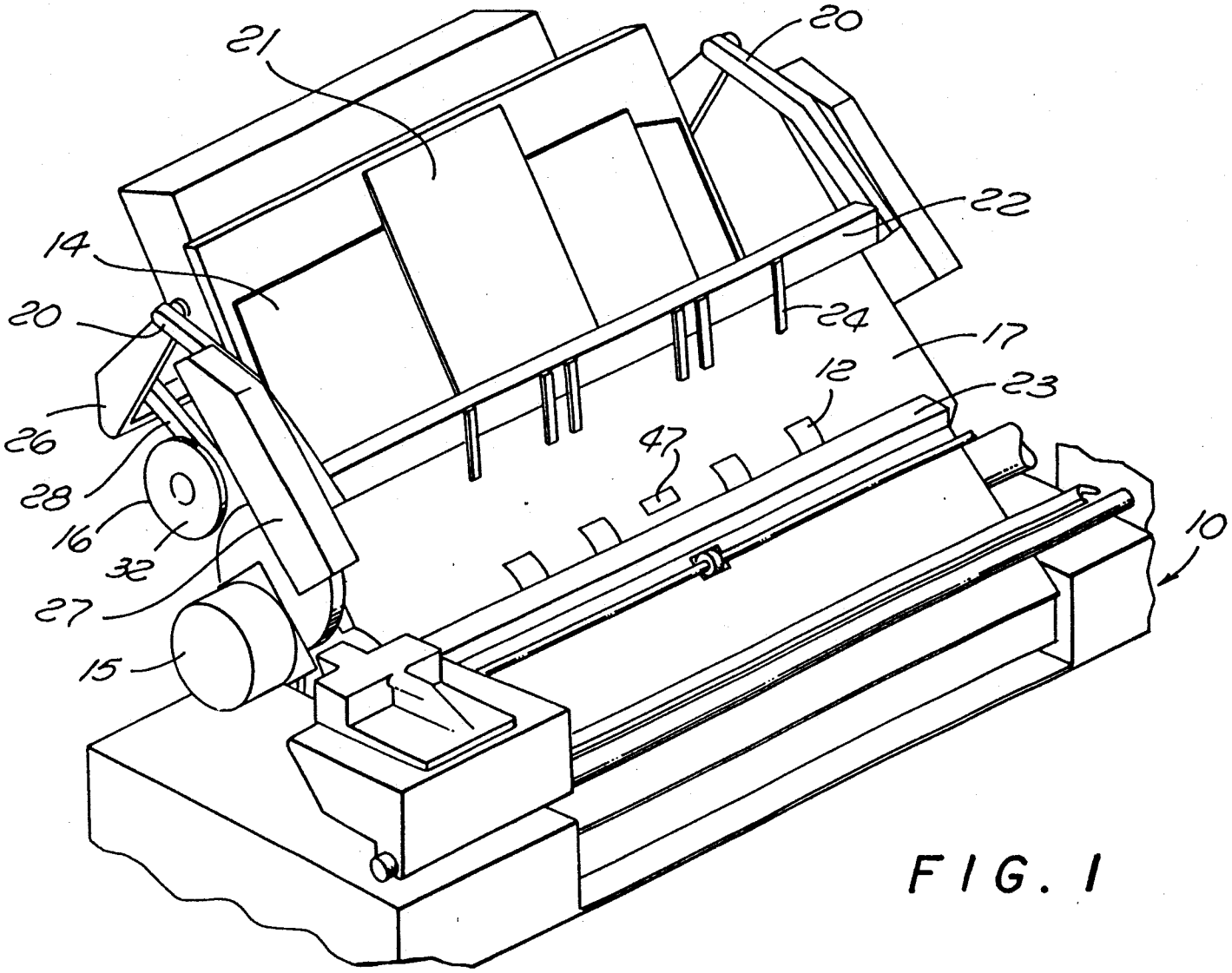
FIG. 1 is a front perspective view of a printer comprising the present invention.
Figure 2:
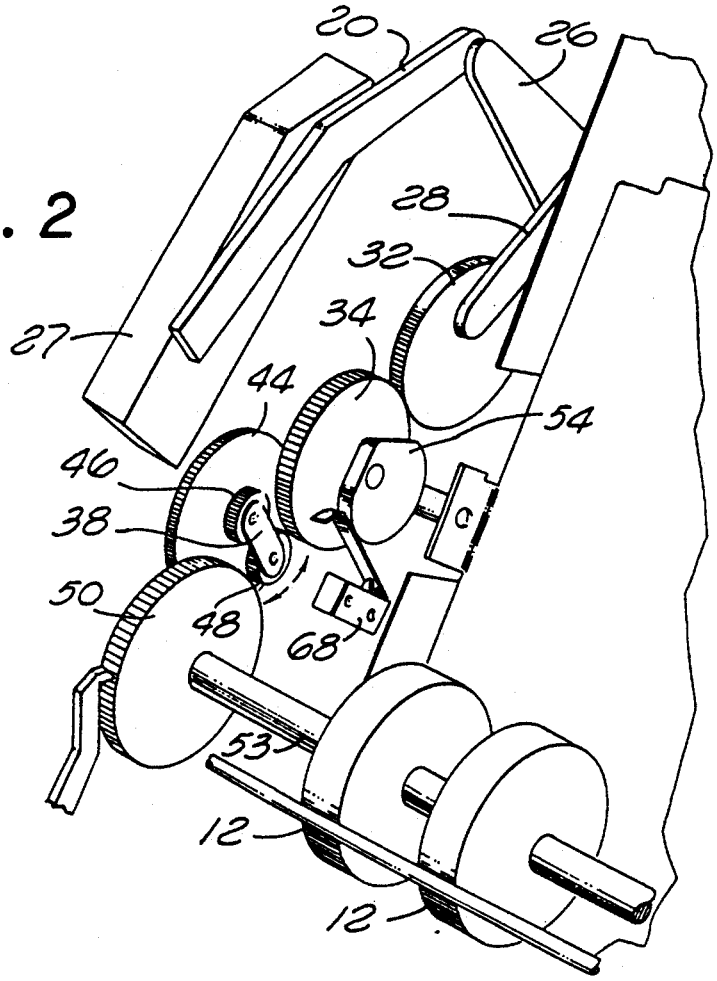
FIG. 2 is a perspective view of the gearing and arm mechanism of the subject invention

As shown in FIG. 1, the present invention comprises generally a printer system particularly suited for ink jet or wet ink printing. The printer 10 comprises one or more rollers 12 for transporting the paper or other print media through the printer. A print platen 17 holds the paper during the printing process which is achieved by a print head (not shown). The print plate or platen is preferably angled backwards at an angle of about 30° to 75°. A paper feed tray 14 is actuated by a lift plate and holds the paper and supplies it to the printer. An output tray 21 collects the paper or other print media after it is ejected from the printer. As shown in FIGS. 1 and 2, the printer, in the preferred embodiment, comprises only a single reversible motor drive 15 to perform all of the functions described below, although multiple motor drives are contemplated as being within the scope of the present invention. The motor drive 15 of the present invention performs three functions, two of which are pertinent to the present invention. First, it drives the rollers 12 which cause the paper to move through the printer. Second, it operates the paper eject means of the present invention, generally represented by numeral 16. A plurality of gears permits the multiple operations.

Figure 7:
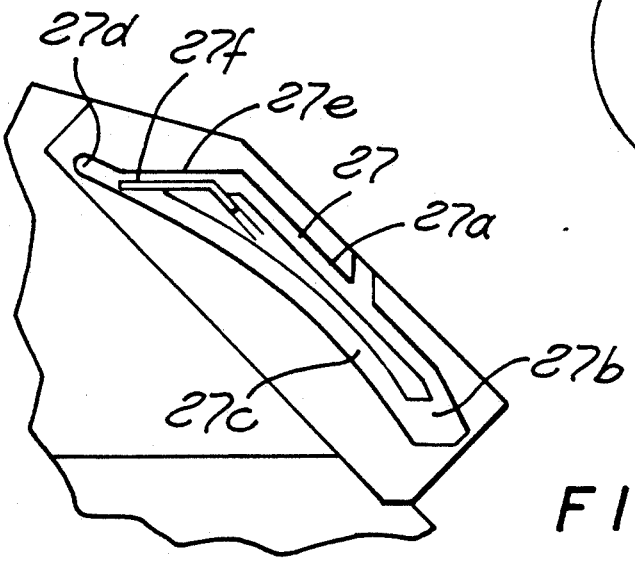
FIG. 7 is a side view of the paper transport means guide means.

Once the paper is transported through the printing portion of the printer, it is transported to a position wherein the bottom of the paper is disposed on a paper support means 23. The paper eject operation and apparatus then takes over to eject the paper out of the printer 10. The paper eject apparatus ejects the paper out of the printer without touching the portion of the paper having the ink printed thereon. The paper eject means comprises in the preferred embodiment a pair of lateral eject arms 20, a eject crossbar 22 connecting the pair of lateral eject arms 20, and a plurality of fingers 24 attached to the eject crossbar 22 and extending generally downward toward the paper. Each lateral eject arm is attached to a rocker arm 26, eject linker arm 28, eject crank 32 which in turn engages a gear 34. One or two paper eject track means 27 are provided to guide the motion of the paper eject means. The paper eject means motion is controlled by the eject track means shown in FIG. 7, and is roughly rectangular or oval in that the paper eject means moves toward the bottom of a page, and then towards the page so that the fingers engage the bottom of the page, then upwards to lift the page off from the paper support means until the paper is kicked off the paper ledge and into a paper receiving tray. Specifically, when the track **27*a* is engaged the fingers move downward toward the bottom of the platen without touching the platen. Track 27*b* causes the fingers to engage the platen. Track 27*c* causes the fingers to carry the paper or other print media up the platen to be ejected. Track 27*d* is where the paper is ejected. Track 27*e* causes the eject means to pull away from the platen by means of a one way gate such as a leaf spring 27*f*. The shape of track 27*c*** is designed to permit the fingers to track the shape of the platen.

The track means 27 retains a peg 36 (FIGS. 6A–6C) to guide the eject arm. The fingers 24 engage the bottom of the page but never touch the printed portion of the page. The paper eject means is then disengaged until the next sheet of paper is ready to be ejected, and the cycle occurs again. During said disengagement of the paper eject means, the gear toggle may be toggled to activate another function such as paper tray drive for controlling the motion of the paper tray from an engaged to disengaged position, or controlling the rotation of the drive rollers which transport the paper through the printer.

FIG. 2 shows the arrangement of the gear system which can, in the preferred embodiment, control the movement of the ejection means as well as the drive rollers 12. A toggle gear 38 is provided for interchangeably driving either operation, depending upon the direction of rotation of the drive gear 44. Drive gear 44 is connectd to the drive motor 15 (FIG. 1) and gear 46 which engages gear 48. When rotated clockwise, gear 48 engages gear 50 which is attached to the axle 53 having the drive rollers 12 mounted thereon, and when rotated counterclockwise gear 48 engages gear 34. Gear 34 is connected to a cam 54 which may operate the movement of the paper feeder in accordance with my copending patent application Ser. No. 07/905,762 filed Jun. 29, 1992. Switch 68 provides a signal relating to the position of cam 54.

Figure 4:
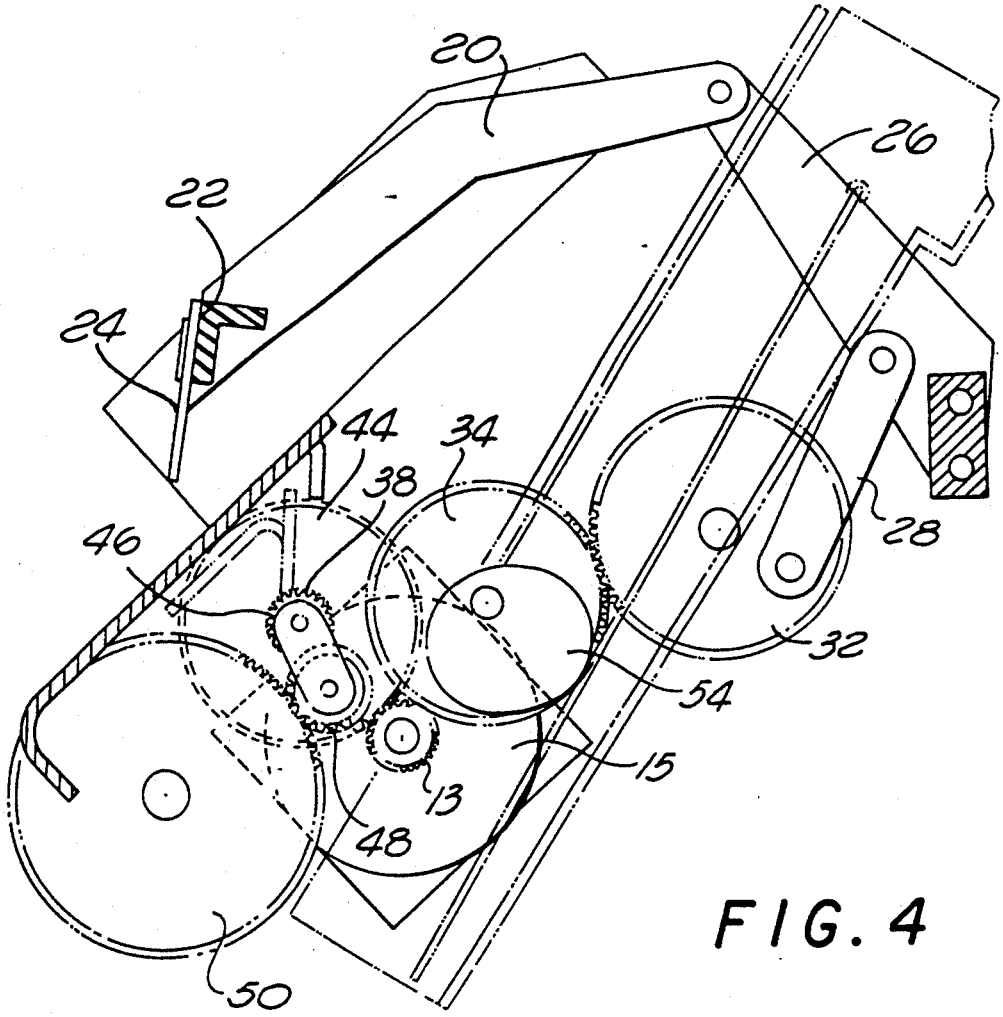
FIG. 4 is a side view of the gearing and arm mechanism of the subject invention.
Figure 5:
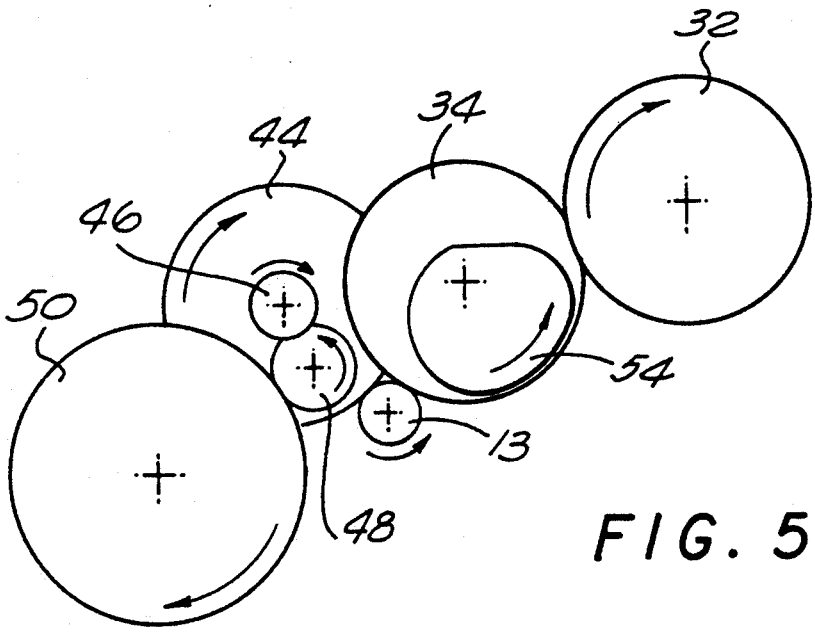
FIG. 5 is a gear directional drawing showing the rotation of the gears of the present invention.

As shown in FIG. 4, the motor 15 drives gear 13 to rotate in either direction. In turn gear 13 drives gear 44 which is attached to gear 46 of toggle assembly 38. Depending upon the direction of rotation, gear 46 engages and rotates gear 48 forcing it to engage either drive gear 50 or gear 34. Gear 34 is attached to cam 54. Gear 34 also engages eject crank 32. FIG. 5 shows the directional rotation of the gear train of the present invention.

Figure 3:
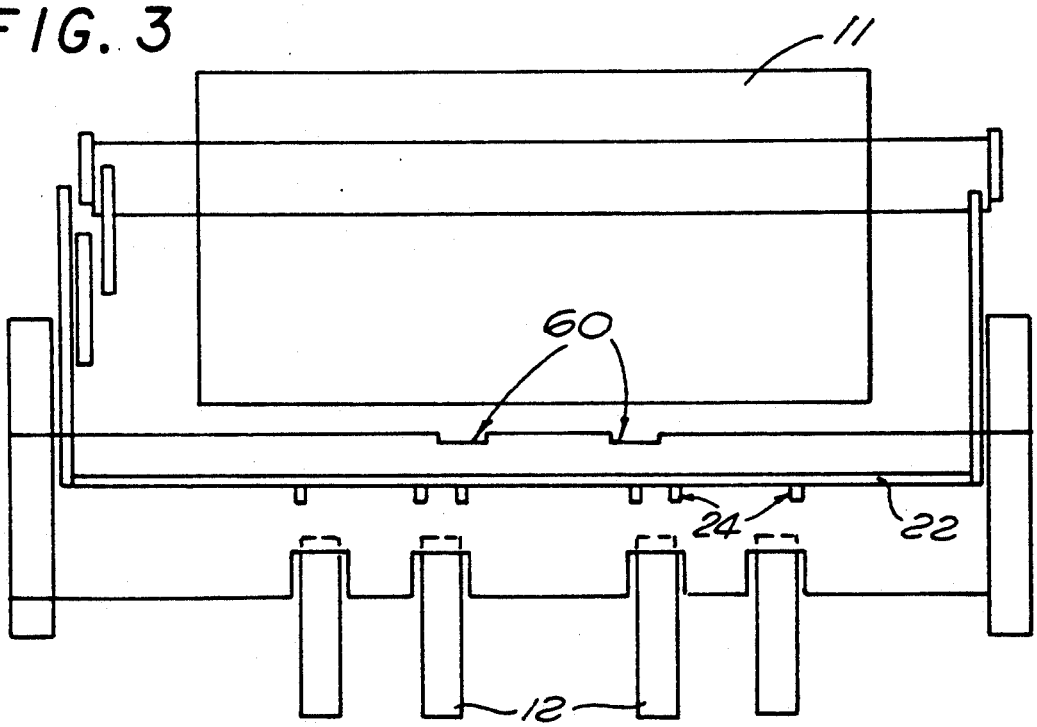
FIG. 3 is a top plan schematic view of the present invention.

FIGS. 3, 6A–6C and 8 show the eject apparatus and how paper is ejected from the printer. As shown in FIG. 3, the rollers 12 transport the paper 11 through the printer. When the paper is transported through the printer it is picked up by the fingers 24 which carry it to the ejection cutouts 60. The alignment of the ejection cutout 60 is such that some of the fingers are aligned with the cutouts, and some are not. This causes the kicking action described below.

Figure 6A:
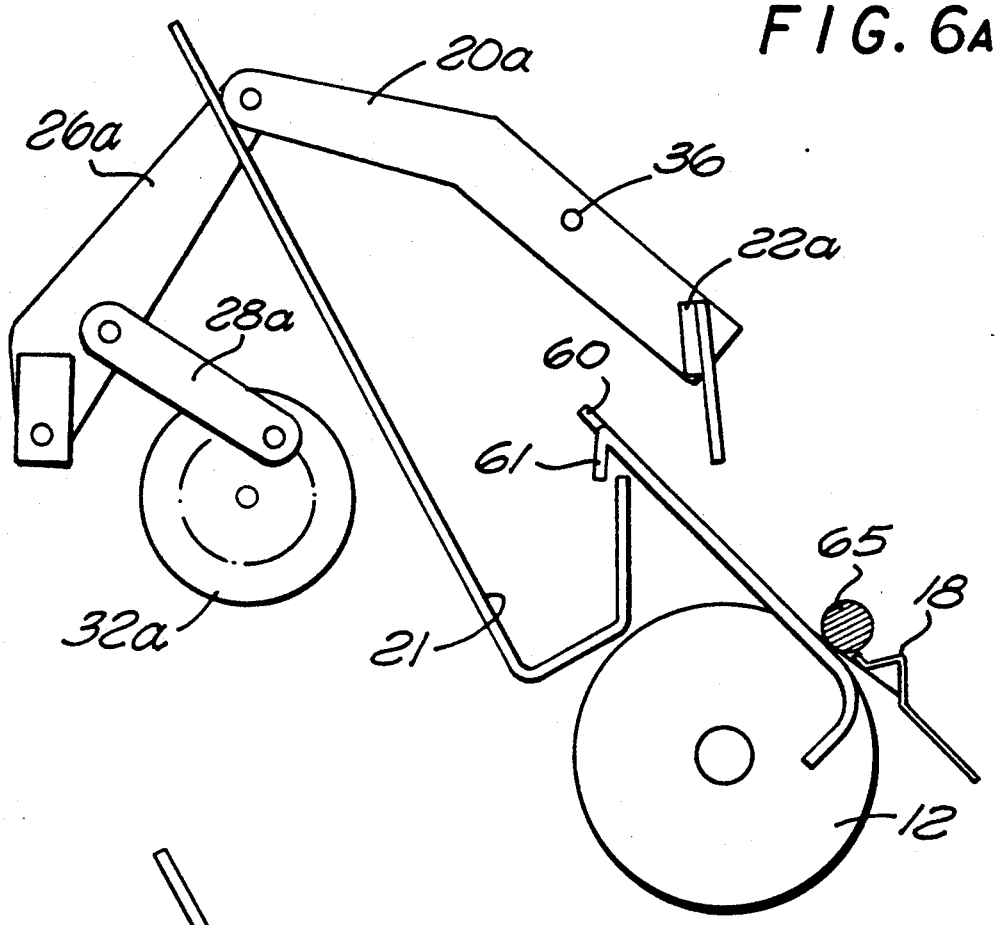
FIGS. 6A, 6B and 6C illustrate a side view of the present invention showing the operation of the print media transport means.
Figure 6B:
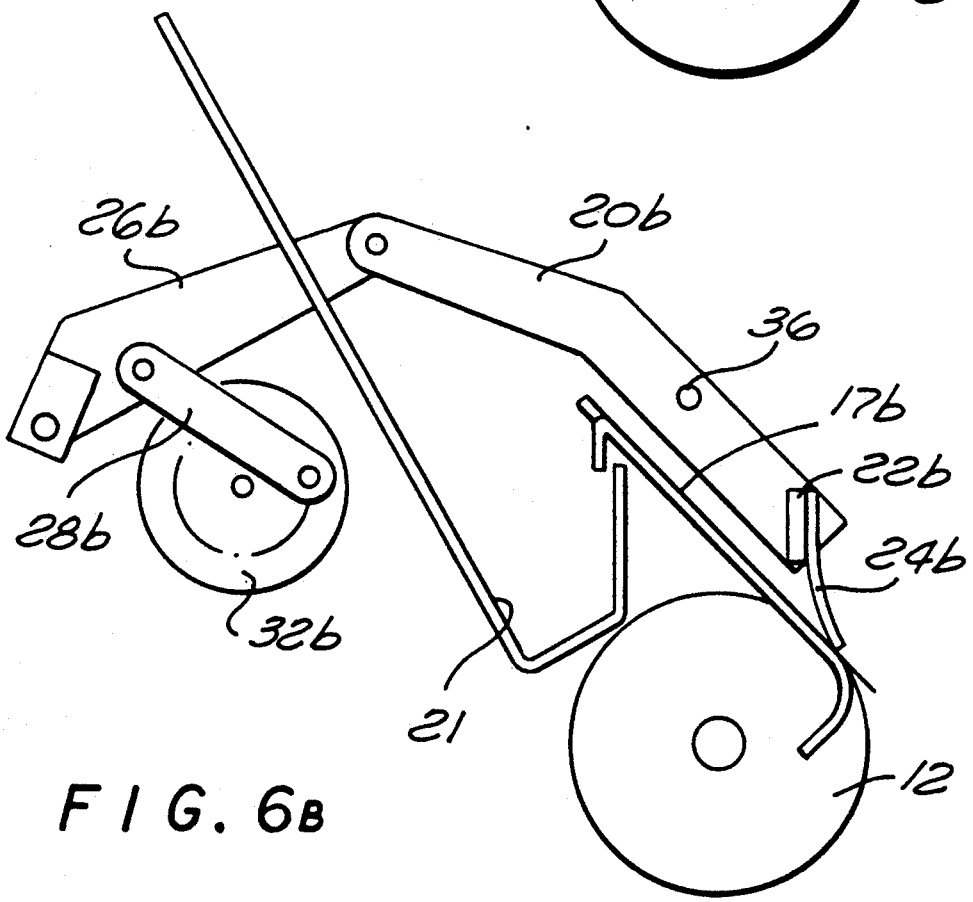
Figure 6C:
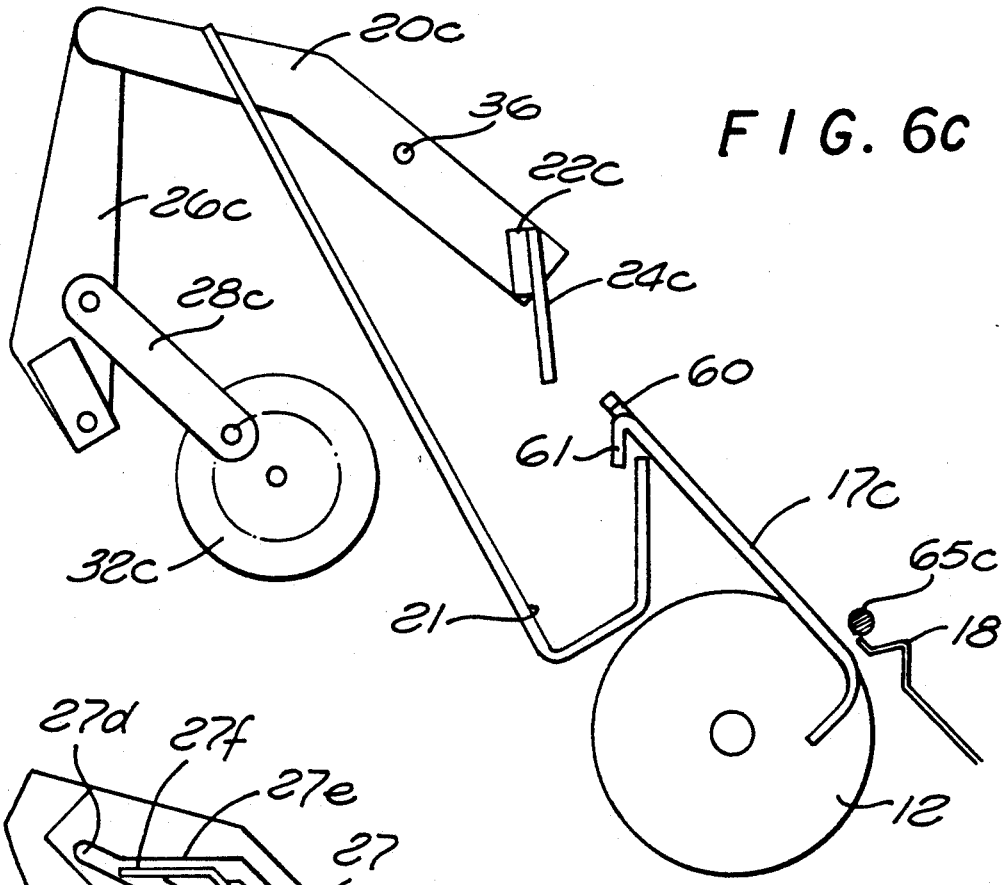

FIGS. 6A through 6C show the movement of the eject arm 20 and fingers through a cycle of the eject apparatus. These are sectional figures are taken through an ejection cutout 60.

In FIG. 6A the finger 24 is poised above the platen 17. The elements previously described are designated with the letter "a" to indicate their position. Similarly, in FIGS. 6B and 6C, the elements are designated with "b" and "c" respectively where necessary to distinguish their different configurations in those Figures. Cutout 60 is shown having a downward bent portion 61 which permits the paper to be kicked out by some of the fingers 24. As shown in FIG. 6*b*, the finger 24*b* is touching the platen 17*b* and is presumably contacting the bottom of a piece of paper (not shown). The finger 24*b* is bent back as it is dragged up the platen. Finally, in FIG. 6*c*, the finger 24*c* is no longer bent after it passes beyond the end of the platen 17*c* and through the cutout 60*c*. Roller 65 retains the print media against roller 12.

Figure 8A:
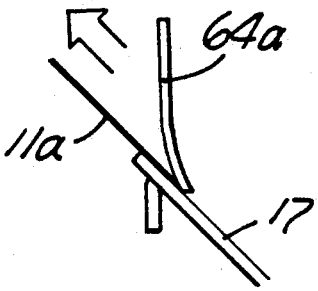
FIGS. 8A, 8B and 8C illustrate a side view of one of the fingers of the present invention showing the operation thereof.
Figure 8B:
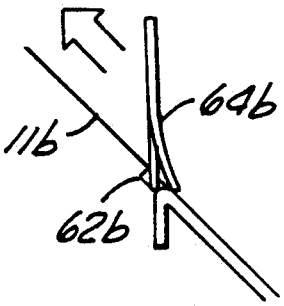
Figure 8C:
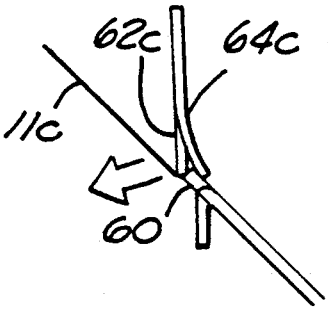

FIGS. 8A–8C show the action of the fingers when passing through the cutout 60. FIGS. 8*a* through 8*c* show two adjacent fingers, one aligned with the cutout, and one not. The finger aligned with the cutout 60 is designated as 62 and is shown as 62*b*–62*c* in FIGS. 8B–8C respectively, and the finger not aligned with the cutout is designated as 64*a*–64*c* respectively (finger 62 is covered in the view shown in FIG. 8A). The drawn arrows in FIGS. 8A through 8C shown the direction of movement of the fingers. As shown in FIG. 8*a*, both fingers 62 and 64 are aligned with each other as they are bent from being dragged up the platen 17. In FIG. 8B, the finger 62*b* falls into cutout 60 and gets underneath paper 11*b*. Finger 64*b* is not yet off the platen. In FIG. 8*c*, finger 64*c* comes off the platen and kicks the paper off the platen in accordance with the present invention. Finger 62*c* supports paper 11*c* in place while it is being kicked off by the finger 64*c*. The paper is kicked into paper collection tray 21, shown in FIG. 6, without the printed surface of the paper ever being touched, thereby reliably and repeatedly discharging the paper from the printer and increases the ease of stacking the paper.

What is claimed is:

1. In a printer having a frame, a paper supply, print head, paper transport means, a printer platen, an paper output tray and a drive motor for driving the paper transport means, the improvement comprising a paper eject means comprising:

an ejector arm movably attached to said frame;

a plurality of flexible fingers attached to said ejector arm and disposed adjacent said platen;

said printer platen having cutouts near an edge thereof and aligned with at least one but not all of said plurality of fingers, said cutouts being adapted to accommodate said fingers which are aligned with said cutouts;

an ejector arm actuating means for moving said ejector arm in a predetermined motion whereby said fingers may be positioned in said cutouts under a piece of paper disposed on said platen and said paper support means, and then transport said paper off said platen;

and whereby said fingers which are not aligned with said cutout kick off said paper into said paper output tray.

2. The printer of claim 1 wherein said ejector arm actuating means is driven by said motor drive.

3. The printer of claim 2 wherein said motor drive is reversible, and said motor drive actuates said paper transport means when rotating in a first direction, and said motor drive actuates said ejector arm when rotating in a second direction.

4. The printer of claim 2 further comprising an ejector arm guide means connected to said frame and said ejector arm for guiding the predetermined motion of said ejector arm.

5. The printer of claim 1 wherein said platen is angled backward at an angle in the range of 30° to 75°.

6. A method of transporting wet print media out of a printer having a platen and an output tray comprising:

supporting said print media at its bottom by a plurality of flexible fingers;

sliding said print media up to the top of a platen on said printer;

causing at least one but not all of said plurality of fingers to unflex at a portion of said platen prior to and near the edge of said platen so that said at least one but not all of said plurality of fingers are moved to a position under said print media;

causing the remainder of said plurality of fingers to unflex thereby forcefully ejecting said print media into said output tray.

* * * * *